US011501895B2

(12) United States Patent
Franco et al.

(10) Patent No.: US 11,501,895 B2
(45) Date of Patent: Nov. 15, 2022

(54) CONDUCTOR CABLE AND METHOD

(71) Applicants: Juan Franco, Blacksburg, VA (US); Carl Stoesz, Blacksburg, VA (US)

(72) Inventors: Juan Franco, Blacksburg, VA (US); Carl Stoesz, Blacksburg, VA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/184,124

(22) Filed: Feb. 24, 2021

(65) Prior Publication Data

US 2022/0270784 A1 Aug. 25, 2022

(51) Int. Cl.

| | |
|---|---|
| ***H01B 7/18*** | (2006.01) |
| ***H01B 11/22*** | (2006.01) |
| ***H01B 1/02*** | (2006.01) |

(52) U.S. Cl.

CPC ..... *H01B 7/184* (2013.01); *H01B 1/023* (2013.01); *H01B 1/026* (2013.01); *H01B 11/22* (2013.01)

(58) Field of Classification Search

CPC ..... H01B 1/023; H01B 1/026; H01B 7/184; H01B 11/22; B32B 37/18; E21B 47/123

USPC ..... 174/110 C, 113 C; 385/12

See application file for complete search history.

(56) References Cited

U.S. PATENT DOCUMENTS

| | | | | |
|---|---|---|---|---|
| 2004/0055781 | A1* | 3/2004 | Cornibert | H01B 11/06 174/135 |
| 2014/0056553 | A1* | 2/2014 | Villiger | G01K 1/14 385/12 |
| 2015/0125117 | A1* | 5/2015 | Stoesz | G01D 5/35374 385/51 |
| 2016/0040527 | A1* | 2/2016 | Balagopal | G02B 6/4435 385/13 |
| 2017/0274639 | A1* | 9/2017 | Wysocki | B32B 37/18 |

* cited by examiner

*Primary Examiner* — William H. Mayo, III

(74) *Attorney, Agent, or Firm* — Cantor Colburn LLP

(57) ABSTRACT

A cable core including a body, a recess in the body, and a protrusion extending radially outwardly from the body and along the recess. A cladding disposed radially outwardly of the core is used to create a cable.

17 Claims, 4 Drawing Sheets

CONDUCTOR CABLE AND METHOD

BACKGROUND

Cables are ubiquitous structures in the modern world each having different duties and requirements and hence many different types of cables can be found in varying industries. Some industries need armored cables for various reasons such as metal cladding on cables used for hydrocarbon recover efforts or in other industries having caustic working environments for the cables. While such cables are commercially available, there are difficulties in manufacture that tend to be associated with less than desired performance or higher than desired cost. The art is always receptive to new configuration and methods that address one or more of the shortcomings of the prior art.

SUMMARY

An embodiment of a cable core including a body, a recess in the body, and a protrusion extending radially outwardly from the body and along the recess.

An embodiment of a cable including a cable core having a body, a recess in the body, and a protrusion extending radially outwardly from the body and along the recess, a cladding disposed radially outwardly of the cable core and having an inside diameter in loaded contact with the protrusion, and a conductor disposed in the recess.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
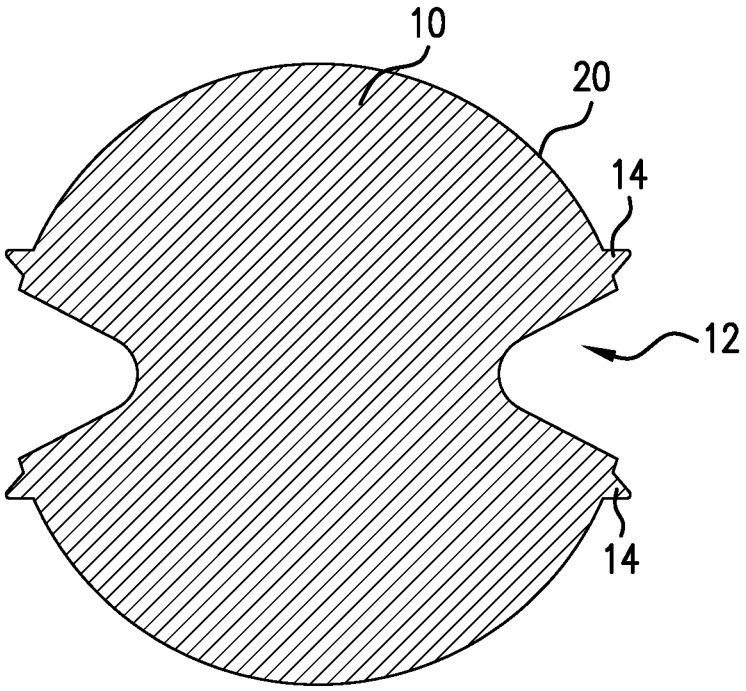
FIG. 1 is a cross sectional view of a cable core as disclosed herein with a first protrusion position.
Figure 2:
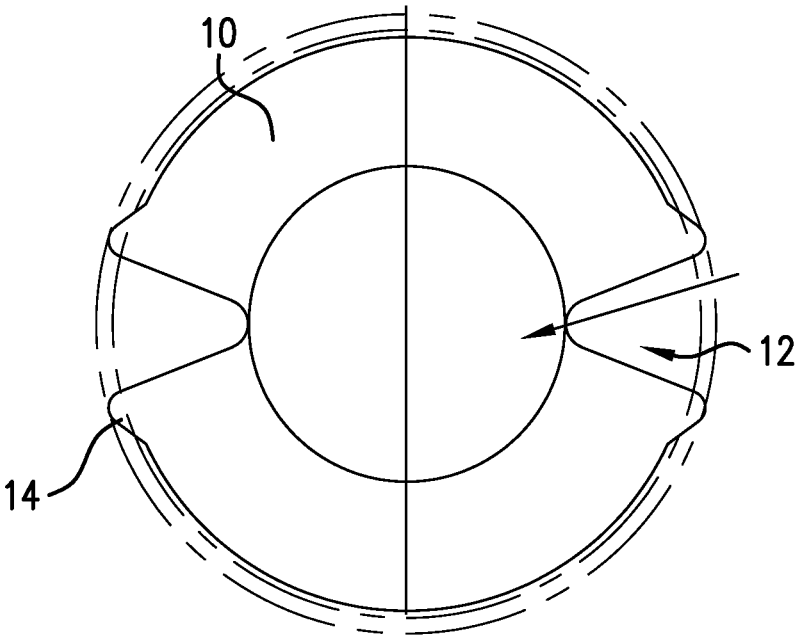
FIG. 2 is the view of FIG. 1 with an alternate protrusion position.
Figure 3:
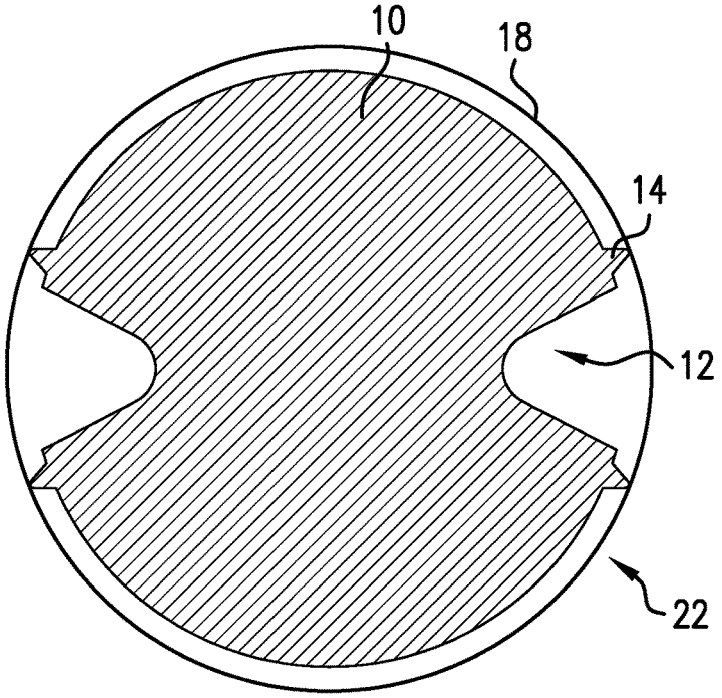
FIG. 3 is a cross sectional view of the FIG. 1 cable core after insertion in a cladding.

Referring to FIG. 1-4, a cable core 10 is illustrated in cross section. The core 10 simplifies the construction of a cable (see FIG. 4) improving efficiency and reducing cost. The core and construction method are particularly suited to constructing optic fiber sensor cables because they support manufacturing without introducing strain into the fiber during the manufacturing process. The cable core 10 and the method disclosed herein however may also be employed for any other type of conductor or other elongated flexible member to be disposed in a cable. Core 10 may comprise a broad range of materials such as aluminum, copper, and might in some cases include plastics, polymers or other formable material depending upon the ultimate application of the cable to be created. In some embodiments though, metals are uniquely advantageous because they are malleable, resistant to high temperatures, protective of the fiber, and effectively transmit strain for applications where that property is desired. In particular embodiments, aluminum and copper have proven to be especially valuable for these reasons. An alloy including at least one of copper and aluminum is also contemplated. It will be appreciated that the core 10 includes a recess 12 that is in the form of a rounded V-shape in the illustration. The recess 12 may also have sharp V shape or a U shape or virtually any other shape deemed desirable. In an embodiment, the V-shape will tend to guide the conductor to a central position since conductors tend to follow the shortest path through a passage. Where an optic fiber sensor is the conductor, consistent positioning within the recess is of benefit relative to accuracy of strain measurement making a V shape useful. At sides of the recess 12 are protrusions 14. The protrusions 14 may be set a small arc length away from the recess 12 as illustrated in FIG. 1 to avoid having the protrusion encroach on the recess 12 after cladding. In an embodiment, the arc distance of the protrusion away from the recess 12 is about the same measurement of the height of the protrusion above an outside surface 20 of the core 10. An alternate embodiment, shown in FIG. 2, positions the protrusions 14 closer to the recess 12. Similar results are achieved but the recess tends to become slightly smaller due to the deformation of the protrusions 14. Protrusions may have any desired shape, with a pointed shape being illustrated. Each protrusion extends to a radius that is larger than an inside diameter (ID) 16 of a finished cladding 18 (FIG. 3) to be disposed thereon. For example, in one embodiment, the radial extent of the protrusions from a longitudinal axis of the core 10 is 0.0925 inches while the inside diameter 16 of the finished cladding 18 is 0.180 inches. This 0.005 inch difference between a circle that includes the protrusion radial dimension and the ID 16 provides a squeeze and therefore a good fluid seal between the protrusions and the ID 16. Other dimensions are contemplated including those that produce a squeeze of about 6% to about 12% calculated by: (1-ID cladding/OD core (meaning the full radial dimension of the protrusion times 2))*100=squeeze %. The point of the dimensions is to create a loaded contact between the core 10 and the cladding 18 such that the protrusion 14 is deformed by the contact enough to create a fluid seal sufficient to convey fluid pumped therein and not allow a conductor to slither out of the recess. The 0.005 inch dimension is an example of a loaded contact that creates seal through compressive deformation of a tip section of the protrusion 14 that is enough to accomplish the goals noted. Each recess, (two shown but more or fewer contemplated) becomes a fluid channel in the same way once the cladding 18 is disposed on the core 10 as can be seen in FIG. 3.

Figure 4:
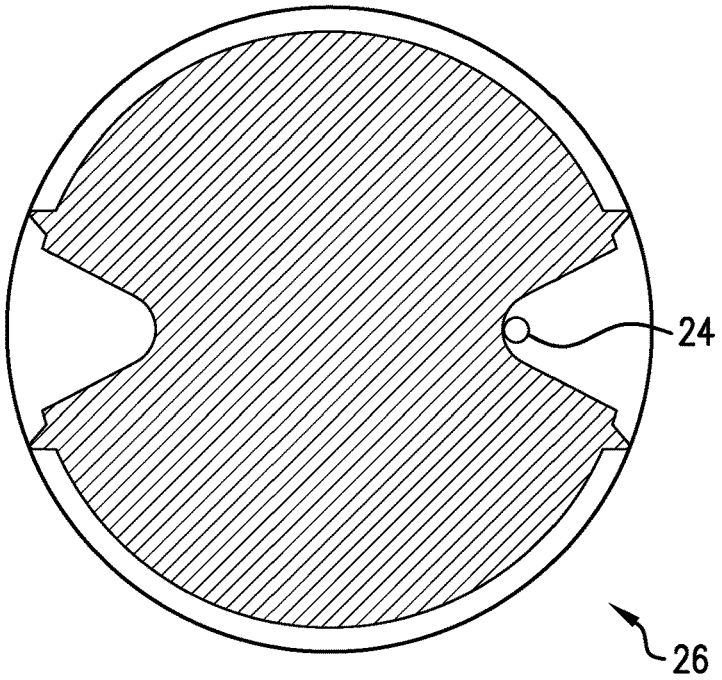
FIG. 4 is the view of FIG. 3 after insertion of a conductor in the cable core to create a cable.

Referring to FIG. 3, the core 10 is illustrated disposed within a cladding 18. The cladding 18 is placed over the core 10 in a known way and so there is no need to discuss that process. It is noted however, that in the art, a conductor 24 (See FIG. 4) is already disposed about the core 10 at the time cladding 18 is traditionally added. This is not the case in the method disclosed herein. Rather, the traditional way of cladding a core is undertaken without a conductor in place. This is illustrated in FIG. 3 where a core 10 is surrounded by cladding 18 and the protrusions 14 are in sealed contact with ID 16 of the cladding 18. No conductor is shown as the method does not add a conductor until after creating a clad core 22. It will be understood that cladding the core 10 would in the prior art induce strain in an optic fiber disposed in the recess 12. That strain would affect functionality of the resulting fiber sensor cable. In the method as disclosed herein however, no strain can be imparted to the fiber, because the fiber is not present in the core 10 during the cladding process. Rather, the present method, after creating the clad core 22, pumps a fluid (gas or liquid) through the recess 12 and entrains a conductor 24 with the fluid to install the conductor 24 in the clad core 22 to create a finished cable 26 (see FIG. 4). Further, an adhesive may be pumped into the recess 12 after or with the conductor 24. In an embodiment the adhesive may be a thermoset material. One specific example of a thermoset material is Epoxy. It is to be appreciated that more than one conductor may be placed in the recess 12 by pumping and that the conductors needn't be all of the same type. Further, although the term "conductor" has been used in discussion, it is further noted that any flexible elongated member of a filamentary type may be pumped into the clad core 22 if desired. Further, and as stated above, the fiber (or other conductor) will tend to the shortest path and so will settle at the vertex of the V shape as shown in FIG. 4. This is useful for optic sensing elements since a knowledge of the position of the fiber improves confidence in sensing accuracy.

Figure 5:
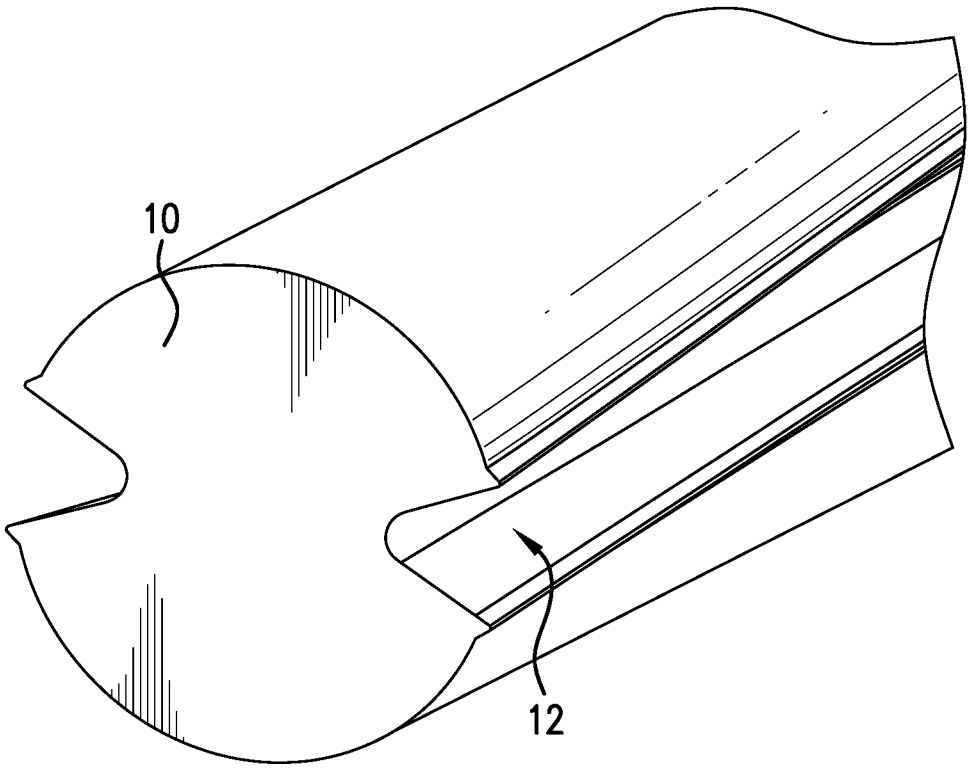
FIG. 5 is a perspective view of a cable core illustrating a helical groove path.
Figure 6:
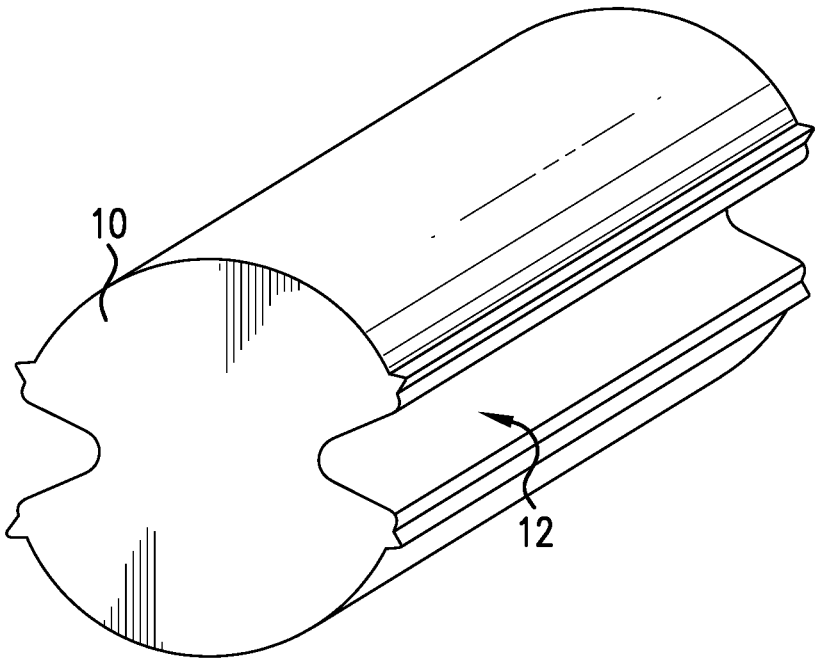
FIG. 6 is a perspective view of a cable core illustrating a straight longitudinal groove path.

Referring to FIGS. 5 and 6, alternative embodiments of core 10 are illustrated showing that either a helical path is dictated for the recess 12 or a straight longitudinal path may also be employed.

Figure 7:
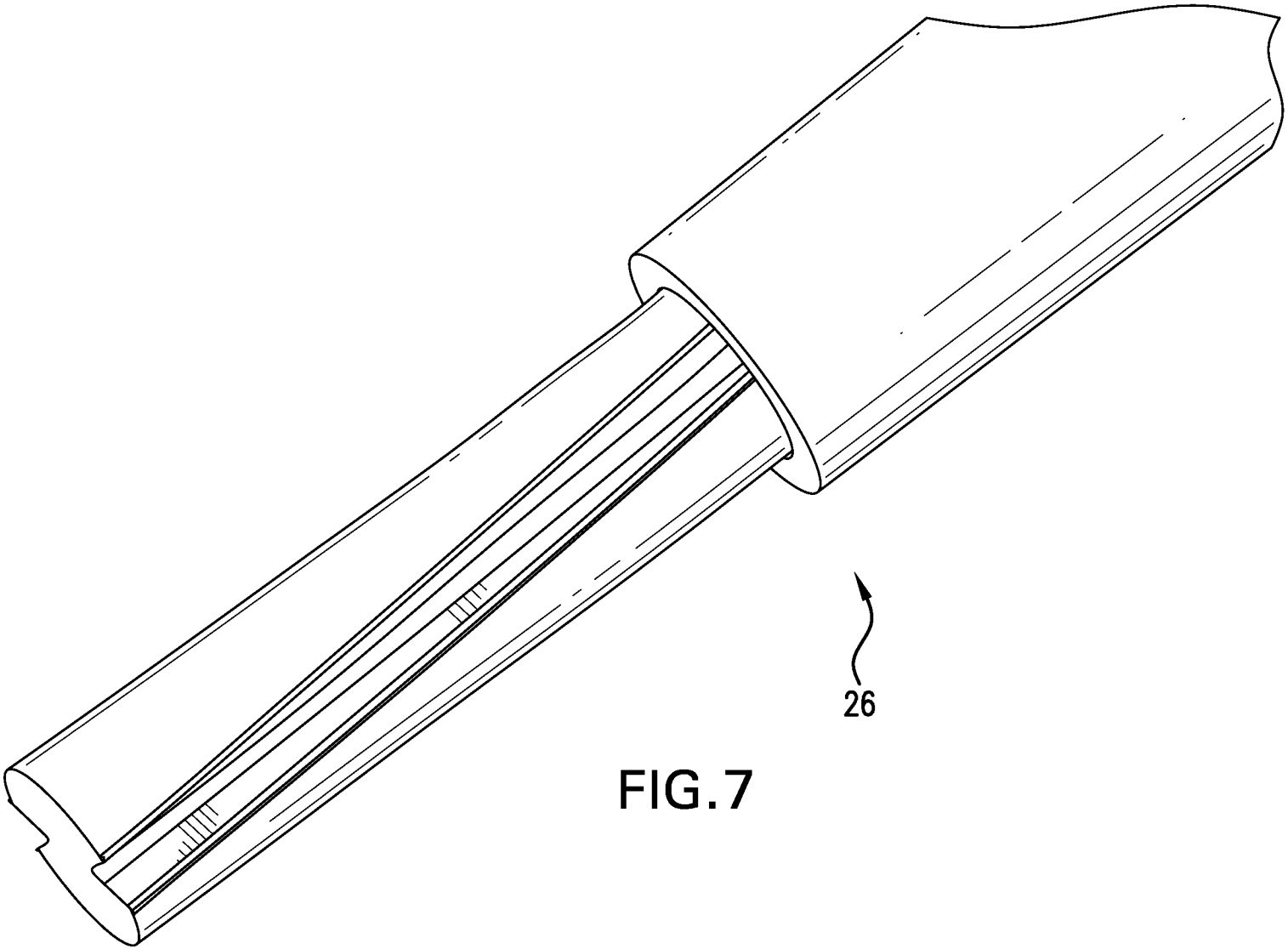
FIG. 7 is a perspective view of the cable with conductor in place and the cladding removed for a portion of the length for clarity of perception.

FIG. 7 is a perspective view of the finished cable 26 with conductor in place and the cladding removed for a portion of the length for clarity of perception.

Set forth below are some embodiments of the foregoing disclosure:

Embodiment 1: A cable core including a body, a recess in the body, and a protrusion extending radially outwardly from the body and along the recess.

Embodiment 2: The cable core as in any prior embodiment, wherein the recess is V-shaped groove.

Embodiment 3: The cable core as in any prior embodiment, wherein the V-shaped groove is a rounded V shape.

Embodiment 4: The cable core as in any prior embodiment, wherein the protrusion is spaced from an edge of the recess.

Embodiment 5: The cable core as in any prior embodiment, wherein the spacing is about equal to a radial dimension of the protrusion.

Embodiment 6: The cable core as in any prior embodiment, wherein the protrusion has a radial dimension from a longitudinal axis of the cable core of 0.0925 inch.

Embodiment 7: The cable core as in any prior embodiment, wherein the protrusion radial dimension relative to a cladding inside diameter to be assembled with the core presents a squeeze of about 6% to about 12%.

Embodiment 8: The cable core as in any prior embodiment, wherein the protrusion exhibits a pointed cross section.

Embodiment 9: The cable core as in any prior embodiment, wherein the body comprises a metal.

Embodiment 10: The cable core as in any prior embodiment, wherein the metal is aluminum or copper or an alloy including at least one of the foregoing.

Embodiment 11: A method for making a cable including disposing the cable core as in any prior embodiment into a cladding having an inside diameter that will make a loaded contact with the protrusion, and deforming the protrusion pursuant to the loaded contact to create a fluid flow inhibiting seal with the cladding.

Embodiment 12: The method as in any prior embodiment further including installing a conductor in the recess after disposing the cable core in the cladding.

Embodiment 13: The method as in any prior embodiment, wherein the installing is by pumping.

Embodiment 14: The method as in any prior embodiment, wherein the conductor is an optic fiber.

Embodiment 15: The method as in any prior embodiment further including pumping an adhesive into the recess after installing the conductor in the recess.

Embodiment 16: The method as in any prior embodiment, wherein the adhesive is a thermoset material.

Embodiment 17: A cable including a cable core having a body, a recess in the body, and a protrusion extending radially outwardly from the body and along the recess, a cladding disposed radially outwardly of the cable core and having an inside diameter in loaded contact with the protrusion, and a conductor disposed in the recess.

Embodiment 18: The cable as in any prior embodiment, wherein the conductor is an optic fiber.

Embodiment 19: The cable as in any prior embodiment further comprising an adhesive in the recess.

Embodiment 20: The cable as in any prior embodiment, wherein the body comprises metal.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A cable core comprising:

a metal body;

a recess in the body; and a protrusion extending radially outwardly from the body and along the recess, the protrusion having a radial dimension relative to a cladding inside diameter to be assembled with the body presents a squeeze of the protrusion of about 6% to about 12%.

2. The cable core as claimed in claim 1 wherein the recess is V-shaped groove.

3. The cable core as claimed in claim 2 wherein the V-shaped groove is a rounded V shape.

4. The cable core as claimed in claim 1 wherein the protrusion is spaced from an edge of the recess.

5. The cable core as claimed in claim 4 wherein the spacing is about equal to a radial dimension of the protrusion.

6. The cable core as claimed in claim 1 wherein the protrusion has a radial dimension from a longitudinal axis of the cable core of 0.0925 inch.

7. The cable core as claimed in claim 1 wherein the protrusion exhibits a pointed cross section.

8. The cable core as claimed in claim 1 wherein the metal is aluminum or copper or an alloy including at least one of the foregoing.

9. A method for making a cable comprising:

disposing the cable core as claimed in claim 1 into a cladding having an inside diameter that will make a loaded contact with the protrusion; and deforming the protrusion pursuant to the loaded contact to create a fluid flow inhibiting seal with the cladding.

10. The method as claimed in claim 9 further including installing a conductor in the recess after disposing the cable core in the cladding.

11. The method as claimed in claim 10 wherein the installing is by pumping.

12. The method as claimed in claim 10 wherein the conductor is an optic fiber.

13. The method as claimed in claim 10 further including pumping an adhesive into the recess after installing the conductor in the recess.

14. The method as claimed in claim 13 wherein the adhesive is a thermoset material.

15. A cable comprising:

a cable core having:

a metal body;

a recess in the body; and a protrusion extending radially outwardly from the body and along the recess, the protrusion having a radial dimension relative to a cladding inside diameter to be assembled with the body presents a squeeze of the protrusion of about 6% to about 12%;

a cladding disposed radially outwardly of the cable core and having an inside diameter in loaded contact with the protrusion; and a conductor disposed in the recess.

16. The cable as claimed in claim 15 wherein the conductor is an optic fiber.

17. The cable as claimed in claim 16 further comprising an adhesive in the recess.

* * * * *